US005308074A

United States Patent [19]

Dorotinsky et al.

[11] Patent Number: 5,308,074

[45] Date of Patent: * May 3, 1994

[54] ADJUSTABLE GOLF SWING TRAINING DEVICE

[76] Inventors: Dennis R. Dorotinsky, 23241 Prospect, Farmington, Mich. 48336; Kenneth G. Lesson, 7002 Timberview Trail, W. Bloomfield, Mich. 48322

[ * ] Notice: The portion of the term of this patent subsequent to Feb. 23, 2010 has been disclaimed.

[21] Appl. No.: 963,117

[22] Filed: Nov. 19, 1992

Related U.S. Application Data

[63] Continuation of Ser. No. 812,735, Dec. 23, 1991, Pat. No. 5,188,366.

[51] Int. Cl.[5] ..... A63B 69/36; A63B 21/12

[52] U.S. Cl. ..... 273/188 R; 482/124; 482/130; 273/DIG. 30

[58] Field of Search ..... 273/188 R, 191 B, 190 R, 273/DIG. 30, 187.2; 482/124, 130; 434/252

[56] References Cited

U.S. PATENT DOCUMENTS

| | | | |
|---|---|---|---|
| 3,442,513 | 5/1969 | Fisher | 273/188 R |
| 3,870,317 | 3/1975 | Wilson | 273/188 R |
| 4,239,228 | 12/1980 | Norman et al. | 273/189 R |
| 5,048,836 | 9/1991 | Bellagamba | 273/188 R X |
| 5,062,642 | 11/1991 | Berry et al. | 273/188 A X |
| 5,188,366 | 2/1993 | Dorotinsky et al. | 273/188 R |

*Primary Examiner*—George J. Marlo
*Attorney, Agent, or Firm*—Brooks & Kushman

[57] ABSTRACT

An adjustable golf swing training device is provided together with a method for its use to guide a golfer through a golf swing with proper hip turn and body rotation. The device comprises an adjustable belt to be affixed to the golfer which is movable with the golfer during a golf swing, a stake for affixing the training device to a ground mass, and a resilient cord. The resilient cord includes a first end which is affixed to the stake and a second end which is adjustably affixable to the belt. The resilient cord is stretchable to create a bias on the belt which is sufficient to guide the golfer through a down swing with proper hip turn and body rotation.

1 Claim, 2 Drawing Sheets

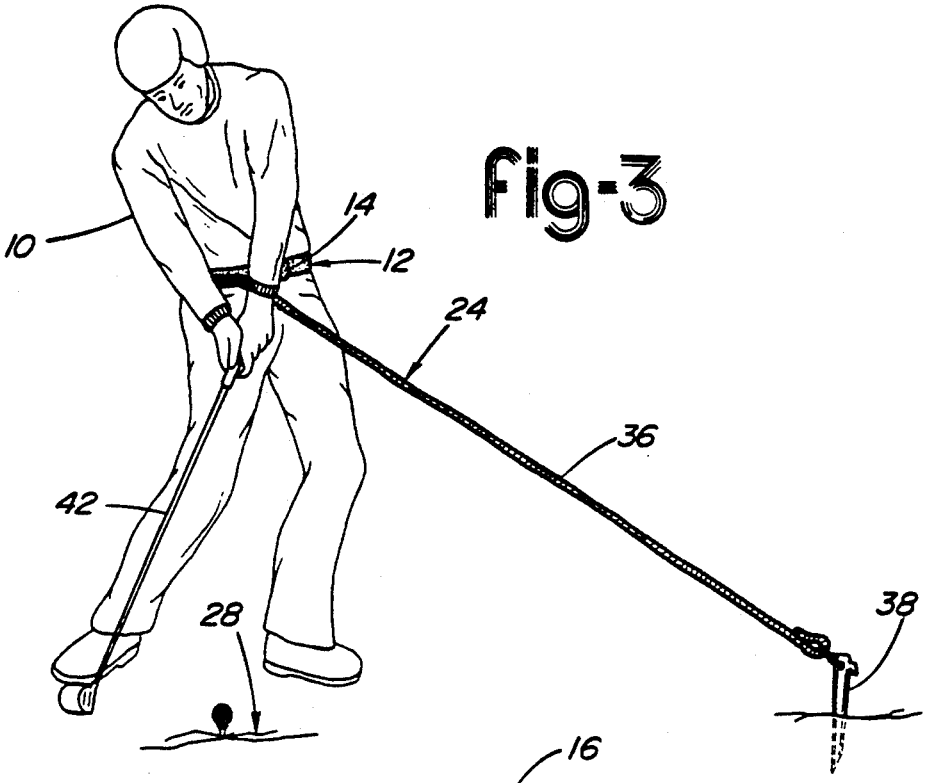
Fig-3
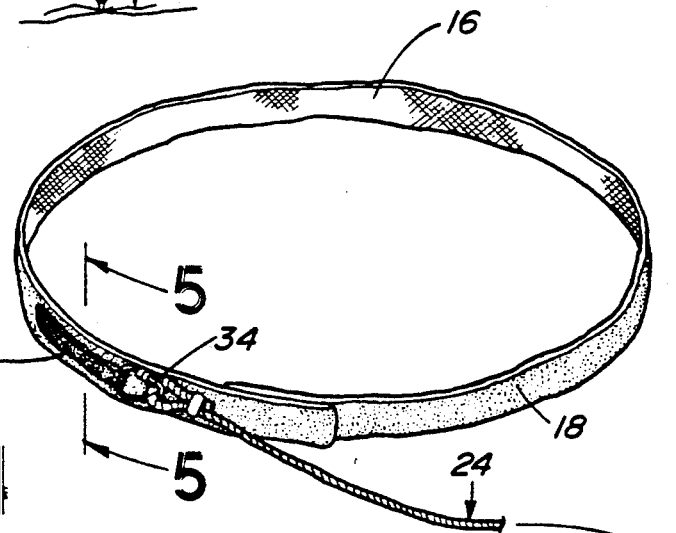
Fig-4
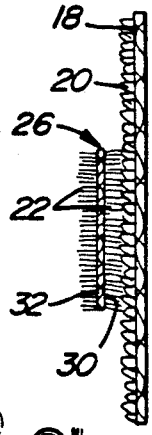
Fig-5
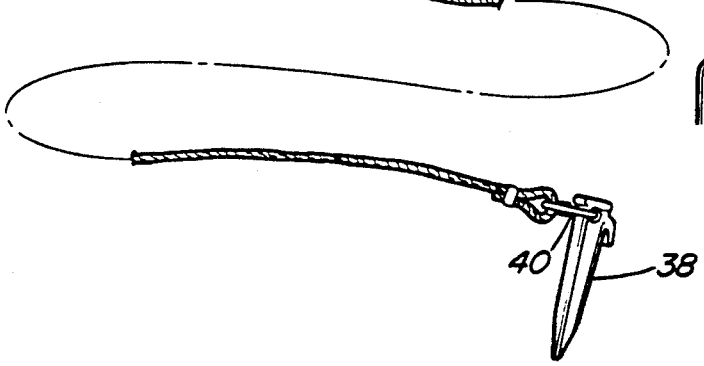

ADJUSTABLE GOLF SWING TRAINING DEVICE

This is a continuation of copending application(s) Ser. No. 07/812,735 filed on Dec. 23, 1991, now U.S. Pat. No. 5,188,366.

TECHNICAL FIELD

The present invention relates generally to a golfer's aid and more particularly to an adjustable golf swing training device for use in guiding a golfer through a down swing with proper hip turn and body rotation.

BACKGROUND OF THE INVENTION

Various mechanical devices have been proposed and used in the past to improve the swing of the average golfer. These devices, though operative to some degree, have proven to be rudimentary in design and thus awkward in their use. Indeed, these prior art devices generally require multiple attachments to the user which may distort the natural feel of the club and impede, rather than guide, the golfer's movements. For example, U.S. Pat. No. 2,893,736 and U.S. Pat. No. 4,134,589 issued to Tesi and Arena, respectively, require the attachment of rope segments to belt loops located adjacent the hips of a golfer. As disclosed in the '736 and '589 patents, the segments are used to restrain the rotational movements of a golfer during his or her swing.

These prior art devices also suffer from a lack of or limited adjustability thus proving undesirable to users. For example, U.S. Pat. No. 3,870,317 issued to Wilson discloses an elastomeric training device used in conjunction with a belt, a rope segment and a stake. Conventional devices of this type often require adjustments in the stabilizing segments to arrive at the proper tension. Often, these necessary adjustments are not apparent until the golfer takes an address position over the golf ball or practice tee. For the golfer to then adjust his or her stance, the golfer must leave the address position and physically move the stake a distance closer or farther away, depending on the amount of adjustment needed.

As set forth above, these conventional training devices have proven difficult to use and, in many cases hinder—rather than guide—the user's movements. For these reasons, such devices have seen little use and have had limited success.

SUMMARY OF THE INVENTION

It is an object of the present invention to provide a golf swing training device for use in guiding a golfer through a down swing with proper hip turn and body rotation.

Another object of the present invention is to overcome the limitations of the prior art by providing an adjustable golf swing training device which permits the biasing tension to be adjusted by the user without altering the user's stance or initial address position.

Yet another object of the present invention is to provide an inexpensive golf swing training device which is convenient to use in any location and easy to store.

In carrying out the above objects, there is provided an adjustable golf swing training device comprising a belt for encircling the waist of the user, a stake to be affixed to a ground mass, and a biasing cord which is adjustably affixable to the belt. As more particularly disclosed herein, if provided with sufficient bias, the biasing cord is designed to stretch during the user's back swing and retract during the user's follow-through in order to guide the user with proper hip turn and body rotation In operation, the belt is preferably placed around the waist of the user with tension sufficient to impede rotation about the golfer's hips during use. It is recognized, however, that the belt may also be affixed to the user's leg or other body area in a similar fashion. The attached biasing segment and stake is then affixed to a ground mass. Significantly, once the user has determined the appropriate address position, the biasing segment may then be properly adjusted to create the required bias or tension in the segment. The user need not modify his or her stance or the position of the stake.

Once the user has set his or her position and properly adjusted the training device, the golf swing may be initiated by bringing the club back and rotating the user's hips. The tension created in the biasing cord by the rotation of the user acts to pull and guide the golfer's hips and body through the full golf swing.

As set forth above, the golfer may adjust the bias on the belt to create either more or less tension dependent on the amount of hip turn and body rotation required. Indeed, the greater the bias, the greater the hip turn and body rotation the golfer will experience during operation.

As will be more fully illustrated below, the golf swing training device may be installed quickly and easily and is simple to use and adjust. As a result, it is anticipated that there will be increased use in the industry resulting in greater participation and enjoyment of golf.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 3 is a perspective view of the golf swing training device of the present invention as used by a right-handed golfer in the down swing portion of a golf swing;

FIG. 4 is a perspective view illustrating the golf swing training device of the present invention; and FIG. 5 is a cross-sectional view of the golf swing training device of the present invention as seen through line 5—5 of FIG. 4.

BEST MODE FOR CARRYING OUT THE INVENTION

Figure 1:
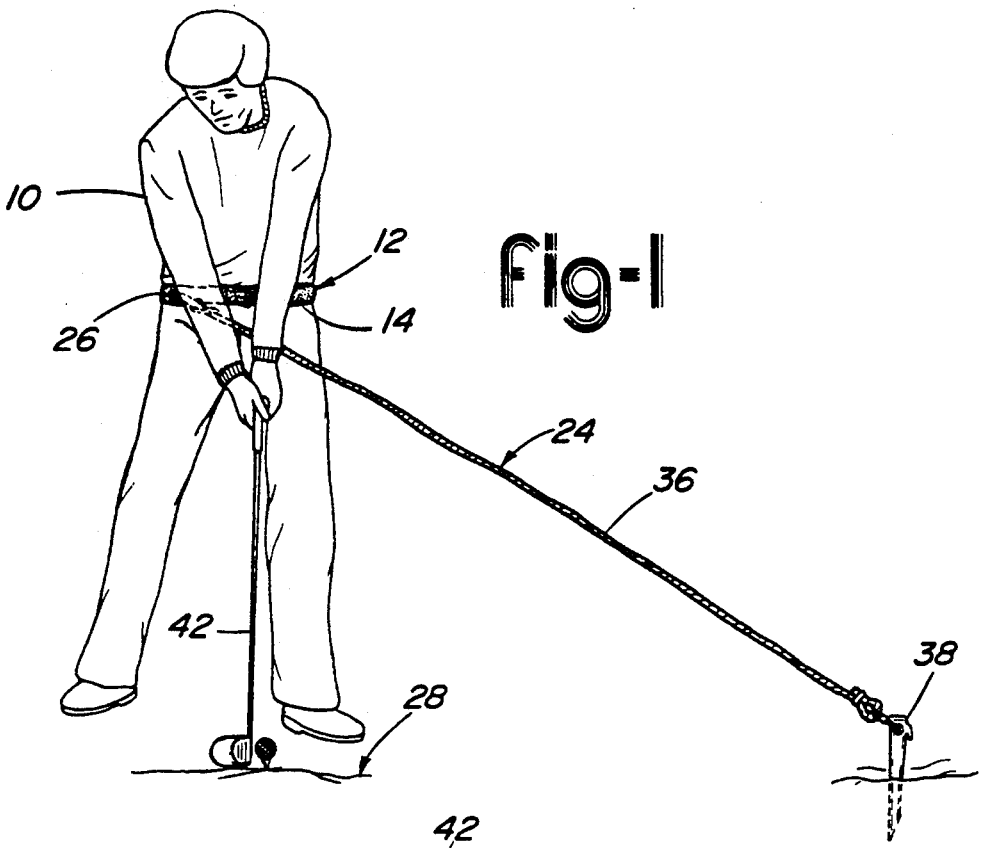
FIG. 1 is a perspective view of the golf swing training device of the present invention as used by a right-handed golfer in the address position.

With reference to FIG. 1 of the drawings, there is shown a golfer 10 wearing the golf swing training device of the present invention. The training device is indicated generally by reference numeral 12. As more fully shown in FIG. 4, training device 12 includes a belt 14 for encircling the waist of the user. The belt is of sufficient overall length and width to accommodate users having varying body height and weight. Applicants have found that an overall length of at least two (2) feet and a width of at least one (1) inch to be acceptable dimensions for accommodating most golfers.

Still referring to FIG. 4, the belt 14 is shown as having an inner surface 16 and an outer surface 18. As further disclosed by applicants, at least a portion of the outer surface 18 may include a plurality of small loop elements 20 extending therefrom. Similarly, at least a portion of inner surface 16 may include a plurality of extending hook elements 22. In operation, loop elements 20 and hook elements 22 are designed to adjustably engage and removably fasten their respective surfaces. Applicants anticipate that commercially manufactured hook and loop fastening systems such as VELCRO® will yield the best result. However, it is understood that any fastening system, including standard belt buckles, may be sufficient so long as means is provided for the user to properly adjust belt 14 to prevent slippage during operation.

The biasing means, generally indicated by reference numeral 24 may be further described with reference to FIGS. 1–5. As shown in the figures, a short segment of material 26 is utilized to fasten belt portion 18 to a ground mass, generally indicated by reference numeral 28 in FIGS. 1–3, explained more fully below. As shown in FIGS. 4 and 5, material segment 26 is disclosed as having an inner surface 30 and an outer surface 32. At least a portion of inner surface 30 may include a plurality of hook elements 22 to adjustably engage and removably fasten surfaces 18 and 30. Significantly, at least a portion of outer surface 32 may also include a plurality of hook elements 22 to similarly engage and removably fasten surfaces 18 and 32. Applicants anticipate that the inclusion of hook elements 22 on dual surfaces 30 and 32 will permit proper use and adjustment of the second biasing means by both right and left-handed users. As in the case of belt 14, applicants anticipate that commercially manufactured hook and loop fastening systems such as VELCRO® will yield the best result. Again, however, it is understood that any fastening system, which permits biasing means 24 to adjustably engage outer surface 18 will be acceptable.

The dimensions of belt 14 and material segment 26 must permit ease of use and adjustability by the user. Thus, while different dimensional characteristics are anticipated, applicants have found that belt 14 should be at least two (2) feet in length and one (1) inch in width to accommodate most golfers. Similarly, material segment 26 should be at least one (1) inch in length and half the width of the corresponding belt 14 to obtain proper adjustment.

Still referring to FIGS. 4 and 5, material strip 26 is shown fastened by metal link 34 to biasing cord 36. At least a portion of biasing cord 36 should be comprised of elastomeric material to provide the proper resiliency and biasing needed to guide the user's hips and body through a proper golf swing. Applicants anticipate that commercially manufactured bungee cords and the like will yield the best result. Again, however, it is understood that any biasing means which is capable of withstanding repeated elastic deformations may be utilized.

The length of biasing cord 36 of course depends upon the amount of lateral tension the biasing cord is capable of creating when stretched. Although different dimensional characteristics are anticipated when varying materials are used under different conditions, applicants have found that a general length of approximately four to six feet will create sufficient bias.

Figure 2:
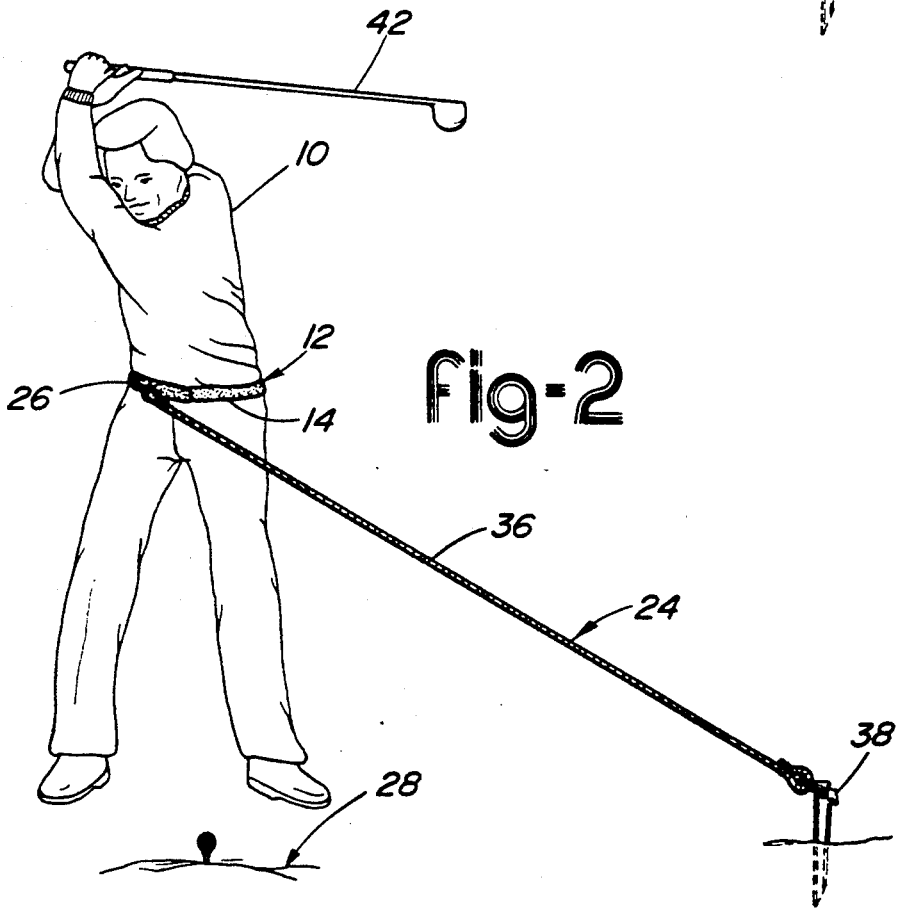
FIG. 2 is a perspective view of the golf swing training device of the present invention as used by a right-handed golfer in the back swing portion of a golf swing.

As shown in FIGS. 1–3, biasing cord 36 is attached to a ground mass 28 through the use of a stake 38 or similar anchoring means. Though not required, a metal link 40 may also be utilized to affix stake 38 directly to biasing cord 36. Stake 38 must be driven sufficiently into the ground mass 28 to prevent removal therefrom during use of the training device by the golfer.

Referring now to FIGS. 1–3, the golf training device of the present invention will now be described in operation. FIG. 1, for example, illustrates a right-handed golfer holding a club 42 in the address position. Belt 14 has been strapped on the user's waist and adjusted with sufficient tension to prevent slippage. Thus, the belt 14 may move freely with the user as the hips of the user rotate.

Although FIGS. 2–3 disclose the operation of the present invention by a right-handed golfer, it should be recognized that both right-handed and left-handed golfers may utilize the present invention without alteration or modification.

In operation, the user must first determine the respective direction the golf shot will follow. Once determined, the user will attach belt 14 to his or her waist or other body area with the proper adjustment. Stake 38 must then be affixed into the ground mass 28 at a point slightly behind and adjacent to the user's left hip as shown in FIGS. 2–3. Of course, a left-handed golfer would affix stake 38 into ground mass 28 at a point slightly behind and adjacent to the user's right hip. Significantly, the distance stake 38 is affixed away from the user must be approximately ¾ the overall length of biasing cord 36.

Once stake 38 is properly installed, the user must determine the appropriate address position by adjusting his or her stance and grip of club 42. Material strip 26 may then be attached to belt 14 at a point approximately adjacent the right hip of the golfer. In the case of a left-handed golfer, material strip 26 should be attached to belt 14 at a point approximately adjacent the left hip. In either case, the connection point should be far enough across the golfer's torso and around the golfer's hip such that a small amount of tension (a first bias) will be created in cord 36. This tension is approximated by removing any slack existing in biasing cord 36 through proper adjustment of material strip 26.

As shown in FIGS. 2 and 3, the user may proceed through a back swing and down swing. In operation, biasing cord 36 has a tension within its length created by the stretching of the cord during clockwise rotation of the user's hips. This tension creates a second bias which reaches a maximum as the user is in his or her full back swing with the user's hips rotated clockwise as far as possible. A down swing may then be initiated by a counterclockwise rotation of the user's hips to release the tension within biasing cord 36. This release of tension contracts the length of the biasing cord 36 thereby pulling the user's hips counter-clockwise and toward stake 38. As more fully shown in FIG. 3, the biasing tension created in biasing cord 36 is minimal, if any, once the user has reached the down swing position. When adjusted and used properly by a right-handed golfer, for example, the golf swing training device of the present invention will cause the user's right hip to rotate approximately ninety (90) degrees while being pulled forward to the address position of the left hip.

It is anticipated that the user will perform a practice swing to determine if the training device is properly adjusted to obtain the required amount of hip turn and body rotation. If greater hip turn or body rotation is required, the user may simply remove and reattach material strip 26 to belt 14 at a point farther clockwise (or counterclockwise) around the user's hips. This latter adjustment will increase the first bias created on the biasing means from that of the practice swing thus causing the user's hips and body to rotate to a greater degree and with greater force during the golf swing. In the alternative, if it is determined that the practice swing results in too much hip turn and body rotation, the bias may be reduced by reattaching material strip 26 to the belt 14 at a point farther counter-clockwise (or clockwise) on the user's hips.

In either case, tension created in the biasing cord 36 may be adjusted without the user changing his or her stance in the address position and without moving stake 38. The adjustment capabilities of belt 14 and biasing means 24, permit various connection positions and uses by golfers having varying degrees of ability. Most importantly, the adjustment capabilities result in greater comfort and thus greater use.

While it is anticipated that the golf swing training device of the present invention will be used predominantly outdoors, the device has been designed for use in indoors as well. For example, stake 38 may be removed and biasing cord 36 may be secured to a permanent fixture such as a floor. In further example, metal link 40 may be affixed directly to a securing eye on the floor of an indoor structure. This use described herein permits the golfer to practice and develop a proper golf swing regardless of whether a golf ball will be hit. Indeed, it is recognized that many indoor golf ranges are now available to the general public which would be ideal for the user of the present invention.

It is further recognized by applicants that the golf training device of the present invention may be positioned to permit the user to properly practice hip turn and body rotation along different terrains. The golf training device disclosed herein is designed to be flexible enough to be utilized in a shallow incline, a steep incline or any plane therebetween to obtain the feel of various golf shots which approximate changes in the terrain on actual golf courses.

While the best mode for carrying out the invention has been described in detail, those familiar with the art to which this invention relates will recognize various alternative designs and embodiments for practicing the invention as defined by the following claims.

What is claimed is:

1. A golf swing training device to be affixed between a golfer and a ground mass for guiding a golfer from an address position to a back swing and through a down swing, comprising:

an adjustable belt for encircling said golfer's waist, said belt including an elongated material strip having an inner surface with a plurality of hook members extending from at least a portion thereof and an outer surface having a plurality of loop members extending from a substantial circumferential extent thereof, such that said belt may be adjustably affixed to the golfer by the interlocking engagement of said hook and loop members;

a ground anchoring stake for affixing said training device to said ground mass;

a resilient cord having a first end affixed to the ground anchoring stake and a second end adjustably affixable to the belt to set a first bias thereon where said golfer is in said address position, the resilient cord being stretchable during said back swing to create a second bias on the belt sufficient to guide said golfer through said down swing with proper hip turn and body rotation; and fastening means for adjustably engaging and removably fastening said resilient cord to said belt when said golfer is in said address position; said fastening means comprising an elongated material strip having an inner surface and an outer surface, the material strip affixed to said resilient cord second end and having a plurality of hook members extending from at least a portion of one surface of said strip for engaging select loop members on the outer surface of said belt so that the resilient cord second end is adjustably affixed to said belt.

* * * * *